US005196816A

United States Patent [19]

Harting et al.

[11] Patent Number: 5,196,816

[45] Date of Patent: Mar. 23, 1993

[54] POLARIZED REVERSIBLE MAGNET

[75] Inventors: Dietmar Harting, Espelkamp; Ernst-Heinrich Hartung, Hessisch-Oldendorf; Joachim Brendel, Espelkamp; Wilhelm Niermann, Wehdem, all of Fed. Rep. of Germany

[73] Assignee: Harting Elektronik GmbH, Espelkamp, Fed. Rep. of Germany

[21] Appl. No.: 857,196

[22] Filed: Mar. 25, 1992

[30] Foreign Application Priority Data

Apr. 4, 1991 [DE] Fed. Rep. of Germany ..... 4110815

[51] Int. Cl.[5] ..... H01H 51/22

[52] U.S. Cl. ..... 335/78; 335/80; 335/128

[58] Field of Search ..... 335/78-86, 335/124, 128, 130-133

[56] References Cited

U.S. PATENT DOCUMENTS 3,987,383 10/1976 Antonitsch ..... 335/78

4,419,643 12/1983 Ojima et al. ..... 335/234

*Primary Examiner*—Lincoln Donovan

*Attorney, Agent, or Firm*—Jordan and Hamburg

[57] ABSTRACT

A polarized, reversible magnet with an essentially U-shaped yoke includes an upper coil former flange constructed like a frame and which fronts on yoke legs provided with tab-like integral moldings which in turn engage recesses of the upper coil former flange. Permanent magnets and pole pieces are inserted from above through appropriate openings of the upper coil former flange into the magnetic system.

18 Claims, 4 Drawing Sheets

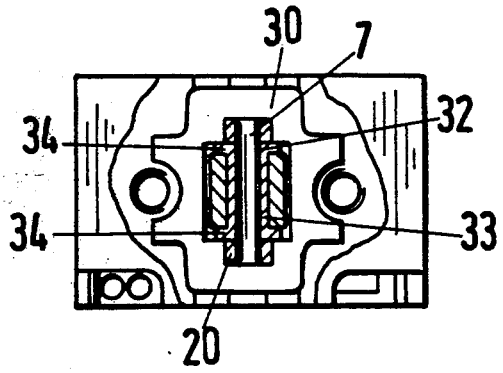
Fig.4
Fig.1
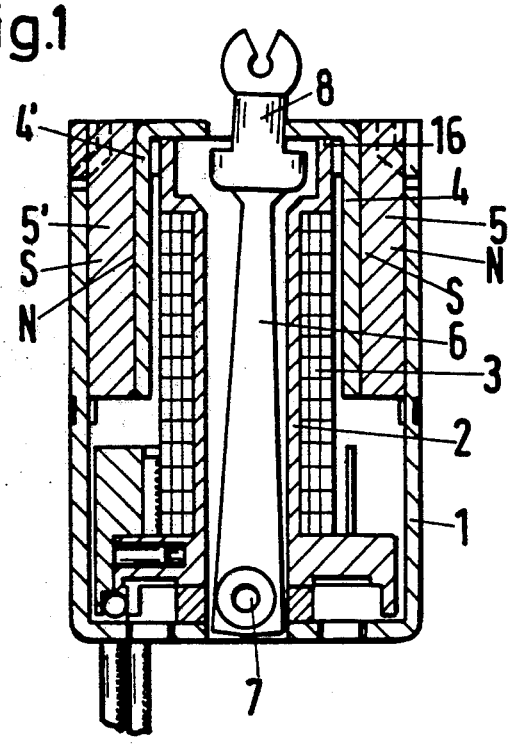
Fig.2
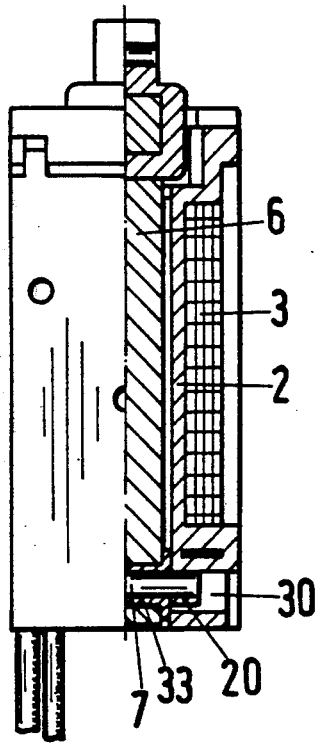
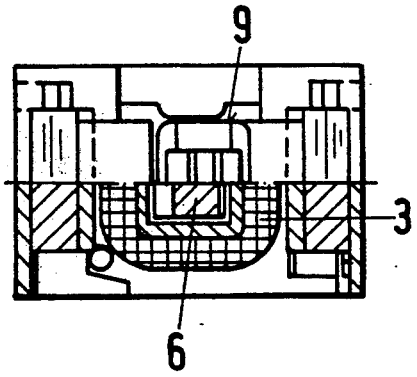
Fig.3

Fig.8
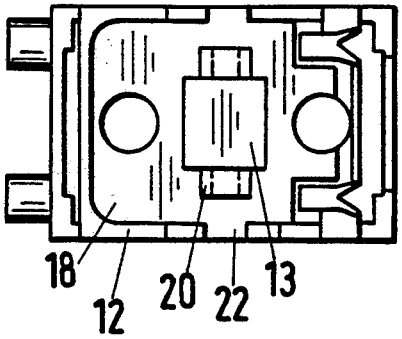
Fig.7
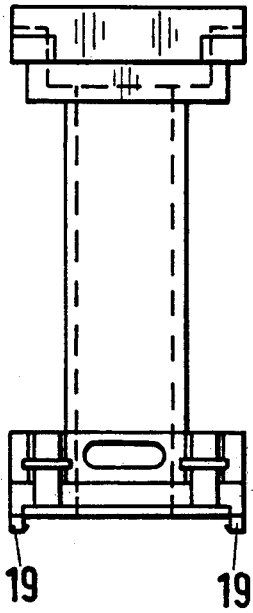
Fig.5
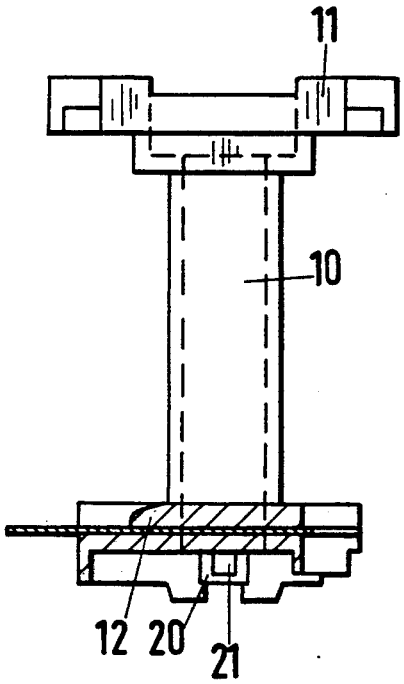
Fig.6
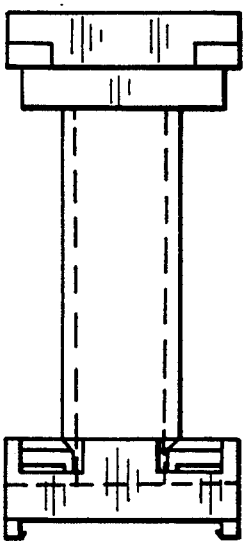
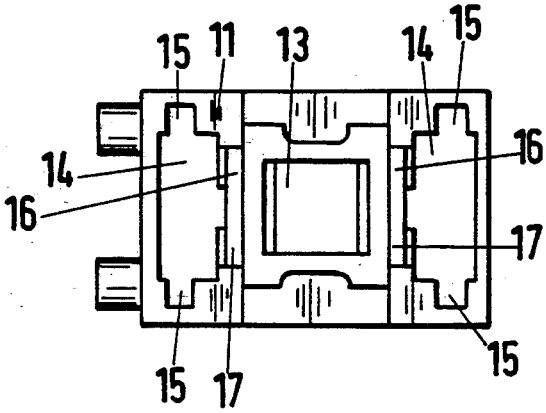
Fig.9

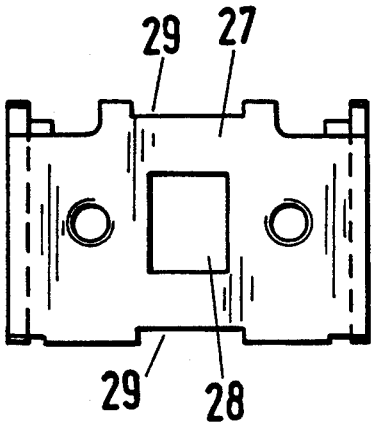
Fig.12
Fig.10
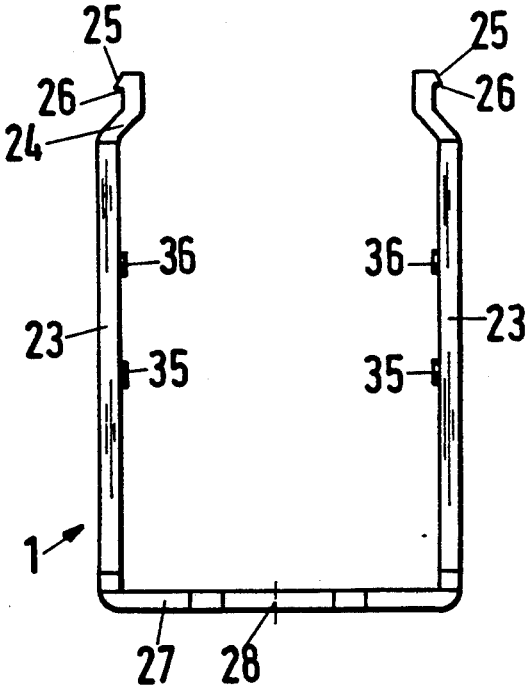
Fig.11
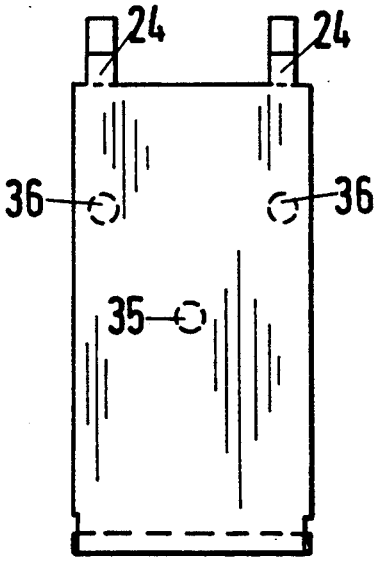

POLARIZED REVERSIBLE MAGNET

The invention relates to a polarized, reversible magnet with an essentially U-shaped yoke, in which a coil former is inserted, with an armature, which passes through the coil former and which can be moved between two pole pieces about an axis facing the yoke bottom, permanent magnets being disposed in the course of the flux of the yoke legs/pole pieces.

BACKGROUND OF THE INVENTION

Such polarized magnetic systems find use for the magneto-magnetic storage of the end positions of the armature. For such magnetic systems, the permanent magnets must be disposed in the course of the flux of the yoke legs of the magnetic system in order to achieve a permanent magnetic holding force in the end position of the armature. Furthermore, an electric coil is required, which, when supplied with an appropriate current, produces an electromagnetic force, which opposes the respective holding force and brings about a movement of the armature into the other end position.

Polarized magnetic systems are known, for which an electric coil is disposed in a U-shaped yoke of a magnet, the armature being provided at its end, which is facing the bottom of the yoke, with an axis, which is held in a recess of a magnetically conductive metal plate that is disposed between the bottom of the yoke and the underside of the coil former. In the case of the known magnetic systems, the permanent magnet, which is required for producing the permanent magnetic force, is inserted between the one longitudinal leg of the U-shaped magnetic yoke and the leg, which is offset 90° to the one pole leg, while the other pole leg is fastened, for example, without interpositioning of a permanent magnet, directly to the other longitudinal leg of the U-shaped yoke of the magnet. In the case of the known magnetic system, the individual parts of this magnetic system, including the coil former but with the exception of the armature that is moveable on the armature axis, are connected to one another and secured in position by adhesive bonds. For such a magnetic system, however, a plurality of individual parts is required, which additionally must be glued together after they are assembled mechanically. For the purpose of maintaining given mechanical values, particularly of the operating air gap, extensive and complicated devices are required, which guarantee these values after the gluing procedure, since, for practical purposes, a correction is no longer possible once the adhesive has cured.

A polarized magnetic system is disclosed in the German offenlegungsschrift 34 18 471. For this system, a holding frame, overlapping the outer sides of the yoke leg, is provided for mounting the individual parts of the system. The holding frame is provided with guiding mechanisms, with which it can be slipped onto the magnetic system so as to fit precisely. For this magnetic system, which on the whole is satisfactory, relatively expensive adjusting work is, however, always still required during the assembly. Moreover, the use of an additional holding frame increases the manufacturing costs.

It is therefore an object of the invention to provide a polarized, reversible magnet of the initially mentioned type, for which the number of individual parts required is reduced to a minimum, which can be assembled without expensive adjusting work and which can therefore be manufactured inexpensively and so as to be easy to install.

This objective is accomplished owing to the fact that the coil former can be pushed with positive engagement into the U-shaped yoke, the lower coil former flange being provided with integral moldings, which engage recesses in or at the bottom of the yoke, that the upper coil former flange is constructed in the form of a frame and has recesses, which are engaged by the upper ends of the yoke legs, and that the bent pole pieces and the permanent magnets can be pushed through openings in the upper coil former flange into the magnetic system, stops at the coil former flange limiting the depth of penetration of the pole pieces.

The advantages achieved with the invention consist, in particular, therein that the complete magnetic system consists of a few individual parts, which are easily assembled, the assembly being accomplished by a simple assembling of the individual parts. Appropriate stops to the insertion of the pole pieces guarantee that the specified working air gap of the magnetic system is always achieved accurately without having to carry out additional adjusting work or use sensing or measuring gauges or other aids.

An embodiment of the invention is shown in the drawings and is described in greater detail in the following.

BRIEF DESCRIPTION OF THE DRAWINGS

FIG. 1 shows a sectional view of a reversible magnet;

FIG. 2 shows the side, semi-sectional view of the reversible magnet of FIG. 1;

FIG. 3 shows the plan, semi-sectional view of the reversible magnet of FIG. 1;

FIG. 4 shows a view of the reversible magnet of FIG. 1 from below;

FIG. 5 shows a view of a coil former;

FIG. 6 shows a side view from the left of the coil former of FIG. 5;

FIG. 7 shows a side view from the right of the coil former of FIG. 5;

FIG. 8 shows a view of the coil former of FIG. 5 from below;

FIG. 9 shows a plan view of the coil former of FIG. 5;

FIG. 10 shows a view of a yoke for the reversible magnet;

FIG. 11 shows a side view of the yoke of FIG. 10;

FIG. 12 shows a view of the yoke of FIG. 10 from below; and

DESCRIPTION OF THE PREFERRED EMBODIMENTS

Figure 13:
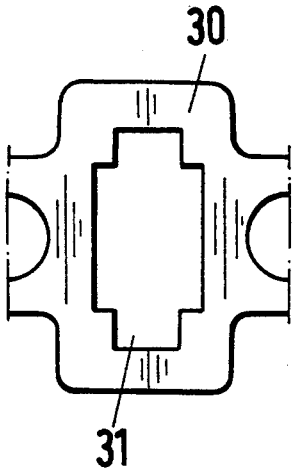
FIG. 13 shows a view of the mounting plate.

The polarized, reversible magnet, shown in FIGS. 1 to 4, consists essentially of a U-shaped yoke 1, a coil former 2 with an excitation winding 3, two pole pieces 4, 4', two permanent magnets 5, 5', as well as an armature 6.

The armature 6 is mounted in the lower part of the coil former by means of an axis 7 and is provided with tap 8, which is integrally molded at the upper end of the armature, for example, as a plastic part. Lateral surfaces 9 of this part serve for the lateral guidance of the armature in the region of the upper coil former flange.

The coil former 2, which is shown in different view in FIGS. 5 to 9, has a rectangular, tubular, middle part 10 as support for the excitation winding, as well as an upper flange 11 and a lower flange 12. An essentially rectangular recess 13 intersperses the whole of the coil former in its longitudinal direction.

The upper flange 11 is provided with two lateral, essentially rectangular openings 14, which change over in each case into two lateral, narrow recesses 15. To form a stop 16 or a bearing surface, the mode of action of which will be explained in greater detail below, openings 14 and a region 17, recessed with respect to the flange surface, are provided in the flange 11 towards the center of the coil former.

Viewed from below, the lower flange 12 is provided with a box-shaped recess 18. In each case, a narrow, downwardly protruding integral molding 19 is formed at the side. Aside from the recesses 13, laterally holding lugs 20 are integrally molded, into the openings 21 of which the bearing pivot 7 is pushed during installation of the magnets. A hole 22 at the side makes it possible to push in the bearing pivot which is disposed within the box-shaped depression 18 after the installation.

In FIGS. 10 to 12, the yoke 1 of the reversible magnet is shown in different views. The yoke consists of a sheet metal part, which is bent in the shape of a U, the two legs 23 of the yoke being formed during the bending process. At the upper ends of the yoke legs, two tabs 24, which are spaced apart and are bent at right angles towards the inside of the yoke, are integrally molded at the front face. At their sides facing the outside of the yoke, the tabs are provided with bevels 25 and, adjoining these, latches 26. The bottom 27 of the yoke finally has a central, rectangular opening 28, as well as two narrow, lateral moldings 29. Moreover, Finally, a mounting plate 30 is shown in FIG. 13. It has a central recess 31, which is such that, when the mounting plate 30 is placed in the box-shaped depression 18 of the lower flange 12 of the spool former, it encompasses the holding lugs 20 as well as the armature that is inserted in the magnetic system. The thickness of the mounting plate is dimensioned to correspond to the depth of the depression 18.

For a better understanding of the invention, the course of the assembly of the parts of the reversible magnet is described briefly below.

In the coil former 2, which was previously provided with the excitation winding 3, the armature 6 is pushed from above in the continuous recess 13, until the bore of the bearing 32 of the armature 6 is aligned with the openings 21 of the holding lugs 20. Subsequently, the bearing pivot 7 is pushed in from the side through the holding lugs into the bore of the bearing. The bearing in the armature 6 can optionally be provided with a bearing bush 33, which has shoulders 34 that protrude over the armature. These shoulders, the lateral surfaces of which are relatively small, serve for centering and for decreasing the friction between the holding lugs or the side walls of the recess 13 in the coil former and the armature.

Subsequently, the mounting plate 30 is placed in the box-shaped depression 18 of the lower coil former flange 12, the lower end of the armature and the holding lugs 20 together with the bearing pivot 7 being accommodated in the recess 31 of the mounting plate. The mounting plate serves, on the one hand, to improve the introduction of the magnetic flux between the armature and the bottom of the yoke and, on the other, to secure the axial position of the bearing axis. The subassembly, so pre-assembled, is then pushed into the U-shaped yoke 1, the tabs 24 at the upper ends of the yoke legs 23 dipping into the recesses 15 of the upper coil former flange and being locked here by means of the latches 26 behind appropriate shoulders of the coil former flange. The tabs 24 are provided with bevels 25, so that they can be pushed more easily into the respective recesses of the coil former flange. In this position of the parts, the lower coil former flange 12 is held laterally guided by means of the integral moldings 19, which engage corresponding moldings 29 in or on the bottom 27 of the yoke. Optionally, the moldings 19 can also be provided with locking means, which interlock with the bottom of the yoke and cause the coil former and the yoke to be held together firmly. In this case, it is then possible to do without the latches 26 at the tabs 24 of the yoke legs.

As a next step, the permanent magnets 5, 5' are pushed through the openings 14 of the upper coil former flange 11 into the magnetic system so as to lie against the inner sides of the yoke legs, until they are fixed in position by the inwardly protruding limiting burls 35. Lateral holding burls 36 serve as additional centering aides for the pushing in of the permanent magnets. The bent pole pieces 4, 4' are then pushed through the openings 14 of the upper coil former flange 11, until the 90° offset part of the pole pieces lies on stops or stop shoulders 16 formed by the depressed regions 17. The appropriate dimensional coordination of the parts ensures that the working air gap between the armature and the pole pieces has a precisely predetermined size without having to use special aids such as gauges, etc.

Aside from a firmer coherence between the coil former and the yoke, the insertion of the upper ends of the pole legs (the tabs 24 into the recesses 15 in the upper coil former flange also accomplishes that, during the operation of the magnetic system, the yoke legs cannot be deflected to the outside, when the armature strikes the responsive pole piece.

The tabs 24, integrally molded to the front side of the yoke legs, preferably are disposed at such a distance from one another that, due to the bending at right angles, the permanent magnets can just be pushed between the tabs. At the same time, when they have been pushed in, the permanent magnets are precisely guided laterally. The permanent magnets and the pole pieces preferably are narrower than the yoke legs 23, as a result of which a mutual interference of closely adjacent magnetic systems is largely prevented.

At the end of the installation, the pole pieces and the permanent magnets are secured in position by a few drops of a rapidly curing adhesive. Optionally, provisions can also be made to fill the cavities between the spool former, pole pieces, permanent magnets and yoke legs with a casting or sealing compound.

What we claim is:

1. A polarized, reversible magnet comprising an essentially U-shaped yoke having a bottom end and two spaced yoke legs extending from said bottom end, said bottom end having recesses, a coil former means disposed between said spaced yoke legs, said coil former means having an upper flange and a lower flange, said lower flange having projections engaging said recesses in said bottom end of said U-shaped yoke, said upper flange having upper flange recesses, each of said two spaced yoke legs having upper end portions which are engaged in said upper flange recesses, permanent magnets positioned between said spaced legs and said coil former means, said upper flange having openings in which said permanent magnets are received, pole pieces disposed between said permanent magnets and said coil former means, said pole pieces being received in said openings, said pole pieces having stop means disposed outside of said openings and engaging said upper flange to determine the position of said pole pieces relative to said upper flange, said coil former means having a longitudinal passage and an armature disposed in said passage, said lower flange having pivot means for pivotably mounting said armature in said passage.

2. A polarized, reversible magnet comprising an essentially U-shaped yoke having a bottom end and two spaced elongated yoke legs extending from said bottom end, said bottom end having recesses, a coil former means disposed between said spaced yoke legs, said coil former means having an upper flange and a lower flange, said lower flange having projections engaging said recesses in said bottom end of said U-shaped yoke, said upper flange having upper flange recesses, each of said two spaced yoke legs having upper end portions which are engaged in said upper flange recesses, permanent magnets positioned between said spaced legs and said coil former means, said upper flange having openings in which said permanent magnets are received, pole pieces disposed between said permanent magnets and said coil former means, said pole pieces being received in said openings, said pole pieces having stop means disposed outside of said openings and engaging said upper flange to determine the position of said pole pieces relative to said upper flange, said upper end portion of each of said yoke legs which are engaged in said upper flange recesses each comprising two inwardly extending tabs which extend inwardly toward said coil former means, each of said elongated yoke legs having a first elongate axis and a first transverse axis perpendicular to said first elongate axis, each of said permanent magnets being elongated, each of said elongated permanent magnets having a second elongate axis and a second transverse axis perpendicular to said second elongate axis, said two tabs on each of said yoke legs being spaced from another along said first transverse axis a distance which corresponds to the transverse width of said permanent magnets as measured parallel to said second transverse axis such that said tabs support said permanent magnets in said position between said yoke legs and said coil former means.

3. A polarized, reversible magnet according to claim 2, wherein said permanent magnets are inserted through said openings in said upper flange into said position between said spaced legs and said coil former means.

4. A polarized, reversible magnet according to claim 2, wherein each of said yoke legs has an inner side facing one another, each of said inner sides having projections which are engageable with said permanent magnets to determine the position of said permanent magnets relative to said yoke legs.

5. A polarized, reversible magnet according to claim 2, wherein said tabs having a bevel portion disposed at an acute angle relative to the respective first elongate axis, each of said tabs having a projection which interlocks with said upper flange of said coil former means.

6. A polarized, reversible magnet according to claim 2, wherein said projections on said lower flange of said coil former means lockingly engage said recesses in said bottom end of said U-shaped yoke.

7. A polarized, reversible magnet according to claim 1, wherein said lower flange of said coil former means has integrally formed pivot supports, said pivot means comprising said pivot supports and also comprising pin means pivotably mounted in said pivot supports.

8. A polarized, reversible magnet according to claim 1, wherein said pole pieces have upper end portions, said stop means on said pole pieces comprising bent-over parts at said upper end portions, said upper flange having an engaging surface juxtaposed to said openings, said bent-over parts engaging said engaging surfaces.

9. A polarized, reversible magnet according to claim 1, wherein said upper end portions of said yoke legs which are engaged in said upper flange recesses comprise inwardly extending tabs which extend inwardly toward said coil former means.

10. A polarized, reversible magnet according to claim 9, wherein said tabs are integrally formed with said U-shaped yoke.

11. A polarized, reversible magnet according to claim 9, wherein each yoke leg has two of said tabs.

12. A polarized, reversible magnet according to claim 2, wherein each of said pole pieces are elongated, each of said elongated pole pieces having a third elongate axis and a third transverse axis perpendicular to said third elongate axis, the width of said yoke legs measured parallel to said first transverse axis being greater than the width of said permanent magnets measured parallel to said second transverse axis and also greater than the width of said pole pieces measured parallel to said third transverse axis.

13. A polarized, reversible magnet according to claim 1, wherein said permanent magnets are inserted through said openings in said upper flange into said position between said spaced legs and said coil former means.

14. A polarized, reversible magnet according to claim 1, wherein each of said yoke legs has an inner side facing one another, each of said inner sides having projections which are engageable with said permanent magnets to determine the position of said permanent magnets relative to said yoke legs.

15. A polarized, reversible magnet according to claim 1, wherein each of said yoke legs are elongated and have an elongate axis, said tabs having a bevel portion disposed at an acute angle relative to the respective elongate axis, each of said tabs having a projection which interlocks with said upper flange of said coil former means.

16. A polarized, reversible magnet according to claim 1, wherein said projections on said lower flange of said coil former means lockingly engage said recesses in said bottom end of said U-shaped yoke.

17. A polarized, reversible magnet according to claim 1, wherein said lower flange of said coil former means has a depression, a mounting plate of magnetizable material disposed in said depression, said mounting plate precluding lateral shifting of said pivot means.

18. A polarized, reversible magnet according to claim 1, wherein said pivot means comprises a bearing bushing, said armature having opposed sides, said bearing bushing extending beyond said opposed sides of said armature.

* * * * *